US005088627A

United States Patent [19]

Musel

[11] Patent Number: 5,088,627

[45] Date of Patent: Feb. 18, 1992

[54] MULTI-CHAMBER PACKAGE FOR MIXING AND DISPENSING

[75] Inventor: Robert J. Musel, Pleasantville, N.J.

[73] Assignee: Wheaton Industries, Millville, N.J.

[21] Appl. No.: 557,941

[22] Filed: Jul. 25, 1990

[51] Int. Cl.[5] ..... B67D 5/60

[52] U.S. Cl. ..... 222/145; 206/219; 215/DIG. 8; 222/211; 222/212

[58] Field of Search ..... 222/94, 129, 207, 211, 222/212, 215, 541, 145; 206/219; 215/DIG. 8; 604/82, 89, 416

[56] References Cited

U.S. PATENT DOCUMENTS

| | | | |
|---|---|---|---|
| 2,787,268 | 4/1957 | Greenspan | 215/DIG. 8 X |
| 2,807,384 | 9/1957 | Lipari | 215/DIG. 8 X |
| 2,813,649 | 11/1957 | Lipari | 215/DIG. 8 X |
| 2,817,104 | 12/1957 | Hartzell | 15/121.2 |
| 3,187,966 | 6/1965 | Klugis | 222/541 |
| 3,347,410 | 10/1967 | Schwartzman | 222/80 |
| 3,347,420 | 10/1967 | Donoghue | 222/129 |
| 3,458,076 | 7/1969 | Babcock | 215/6 |
| 3,599,838 | 8/1971 | LaVagne | 222/129 |
| 3,628,700 | 12/1971 | Donoghue | 222/207 |
| 3,651,990 | 3/1972 | Cernei | 222/94 |
| 3,870,147 | 3/1975 | Orth | 206/222 |
| 4,936,446 | 6/1990 | Lataix | 206/219 X |
| 4,986,322 | 1/1991 | Chibret et al. | 206/219 X |

FOREIGN PATENT DOCUMENTS 3611925 10/1987 Fed. Rep. of Germany .

*Primary Examiner*—Michael S. Huppert
*Assistant Examiner*—Joseph A. Kaufman
*Attorney, Agent, or Firm*—Ratner & Prestia

[57] ABSTRACT

A multi-chambered container for mixing and dispensing having at least two chambers separated by a passageway and including an exterior opening with a non-removable closure. The closure having an integral nozzle and adapted for attachment to the open end of a tubular member with a closed stopper end adapted for forming a plug seal of the passageway between the chambers. The tubular member has openings in its sidewall to allow sampling of the ingredient of the upper chamber in the closed position and dispensing of the commingled ingredients in the open position through the integral nozzle of the closure.

13 Claims, 2 Drawing Sheets

MULTI-CHAMBER PACKAGE FOR MIXING AND DISPENSING

FIELD OF THE INVENTION

This invention relates to a multi-chambered container for storage and sampling of separated components and for mixing and dispensing of resulting product.

BACKGROUND OF THE INVENTION

The following is a brief description of known prior art teachings which may be considered material to the examination of this application.

German patent DE-3611925-A1 teaches a waisted bottle having two chambers separated by an X-shaped waist opening. An X-shaped stopper attached to the bottle closure cap by a connecting rod is used to seal the components of the two chambers from one another. The connecting rod may be depressed by screwing the cap downward, unseating the stopper and allowing the components of the two chambers to intermix.

U.S. Pat. No. 3,651,990 teaches a plastic "squeeze bottle" having upper and lower compartments connected by a restricted waist passageway. The restricted waist passageway may be closed by a tubular stem extending through said passageway and connected to an internally threaded cap that is attachable to the threaded bottle neck.

When the cap is removed from the bottle neck, the attached tubular stem is removed from the bottle and inverted. A second internally threaded recess of the cap may be screwed onto the bottle neck when the cap and attached tubular stem are inverted. The components are commingled and dispensed by squeezing the contents of the bottle through the tubular stem.

When in the closed position, an enlargement in the tubular stem surrounded by an O-ring forms a fluid-tight seal with the interior surface of the passageway. The component in the lower chamber is sealed in the bottle by a check valve in the internal passageway of the tubular stem and a closure inserted over the second cap recess. The component in the upper chamber is sealed in the bottle by a plug inserted into an opening of the cap and the closure inserted over the second cap recess.

U.S. Pat. No. 2,817,104 teaches a dual-chambered container in which the lower chamber is designed to contain a tooth-cleaning fluid and the upper chamber has an opening for receiving a toothbrush. The opening between the chambers is sealed by a conical tip of the toothbrush which forms a valve-type closure that seats firmly in the opening. The container also includes a removable cap that has air vents which permit the vented toothbrush to dry.

After the closure on the container is removed sufficiently and the toothbrush displaced slightly (to defeat the valve-type closure), the container device is tilted and a small quantity of a liquid contained in the lower chamber is transferred to the upper chamber for application to the toothbrush. When the brush is removed and the device returned to its upright position, the liquid flows back to the lower chamber.

U.S. Pat. No. 3,347,420 teaches a container having a restricted waist dividing the interior of the container into upper and lower chambers. A vertical sidewall divides the lower chamber into two compartments for storing separate components until the components are transferred to the upper chamber for mixing. The upper and lower chambers are connected by means of a small opening. A transfer spout and tube are inserted in the opening between the two chambers so that when the container is in an upright position, the flexible walls of the lower chamber may be squeezed inwardly to reduce the volume of the lower chamber, creating pressure therein and forcing liquid from the lower chamber, up through the tube and transfer spout, into the upper chamber. The liquid transferred to the upper chamber may be poured through an exterior opening in the upper chamber.

U.S. Pat. No. 3,870,147 is directed to a container for the storage of at least two components plus a solvent, all of which are maintained in separate chambers within the container. A capsule, having separate chambers for the components, extends into the container which is partially filled with a solvent. The capsule includes a sliding sleeve member which, when pressed, extends and pushes the separating bottoms out of their respective chambers and into the container to allow mixing of the substances with the solvent within the container.

U.S. Pat. No. 3,599,838, U.S. Pat. No. 3,458,076, and U.S. Pat. No. 3,347,410 relate to dual-chambered storage and mixing containers in which one chamber of the container is contained within a larger chamber. Both the inner and outer containers are closed by means of a single closure. In the '410 patent, the contents of the separated compartments are combined by pressing a bellows-type cap with a sharpened rod attached. This rod punctures or otherwise defeats an integral seal which separates the two chambers, thus allowing the contents of the chambers to intermix. In the '076 patent and the '838 patent, the contents of the separate compartments are combined by forcing the container closure axially downward relative to the outer compartment to force the inner compartment completely into the outer compartment, thus allowing the ingredients of the compartments to intermix.

FIG. 6 illustrates a dual-chambered container 10 with a central constriction 12 between upper and lower chambers. The upper chamber 16 includes an exterior opening 22 with an elongated neck 20, through which a stem applicator 52 and fill-tube 48 assembly is inserted to seal the passageway 18 connecting upper and lower chambers with an attached plug seal 46. The stem applicator and fill tube assembly is attached to a closure means 30, which, when removed, displaces the plug seal 46 from the passageway 18 allowing contents of upper and lower chambers to commingle. The assignee of the present invention made a prototype of a container of this type and offered it for sale to a customer more than one year before the present application was filed.

Applicants submit herewith copies of the foregoing references, including the subject matter of FIG. 6, in respect of which there may be a duty to disclose in accordance with 37 CFR §1.56. Also enclosed is PTO Form 1449 which lists these references.

The foregoing is intended to constitute an Information Disclosure Statement in accordance with 37 CFR §1.97. Although these references and related information may be "material", citation thereof is not intended to constitute an admission that any patent, publication or other information referred to is "prior art" for this invention unless specifically designated as such. This Information Disclosure Statement shall not be construed to mean that no other material information, as defined in 37 CFR §1.56(a), exists.

BRIEF DESCRIPTION OF THE INVENTION

The present invention comprises a container and cap combination for storing of ingredients, normally maintained separate until commingled immediately prior to use, and for commingling and dispensing the ingredients. The container includes two chambers with a connecting passageway and the cap includes a tubular member which seals the passageway closed when the cap is in a first "closed" position. The cap also includes an openable outer end through which fluid in the tubular member may be dispensed. The tubular member includes a sidewall opening, by which an ingredient to be stored in the upper chamber can be introduced into that chamber when the tubular member is in the "closed" position in the passageway, and through which ingredients of both chambers may pass and be dispensed, when the passageway is unsealed or in an "open" position. The cap is adapted, with the attached tubular member, to be moved from its "closed" position, where it may be retained by a threaded engagement, for example, to an "open" position, in which it is retained on the container. Preferably, an integral nozzle on the cap with a snip-off tip serves as an outlet means for the ingredients and allows the contents of the container to be dispensed without the closure being removed.

DETAILED DESCRIPTION OF THE INVENTION

Figure 1:
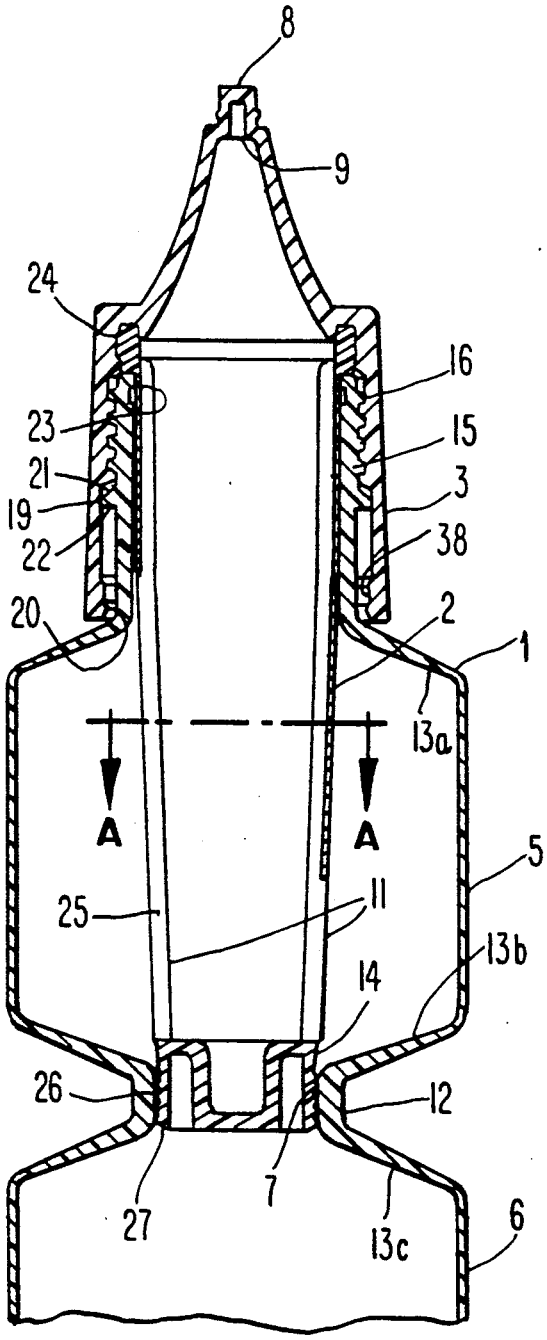
FIG. 1 is a cross-sectional view of a preferred embodiment of the multi-chambered storage and mixing container of the present invention in the closed position.
Figure 2:
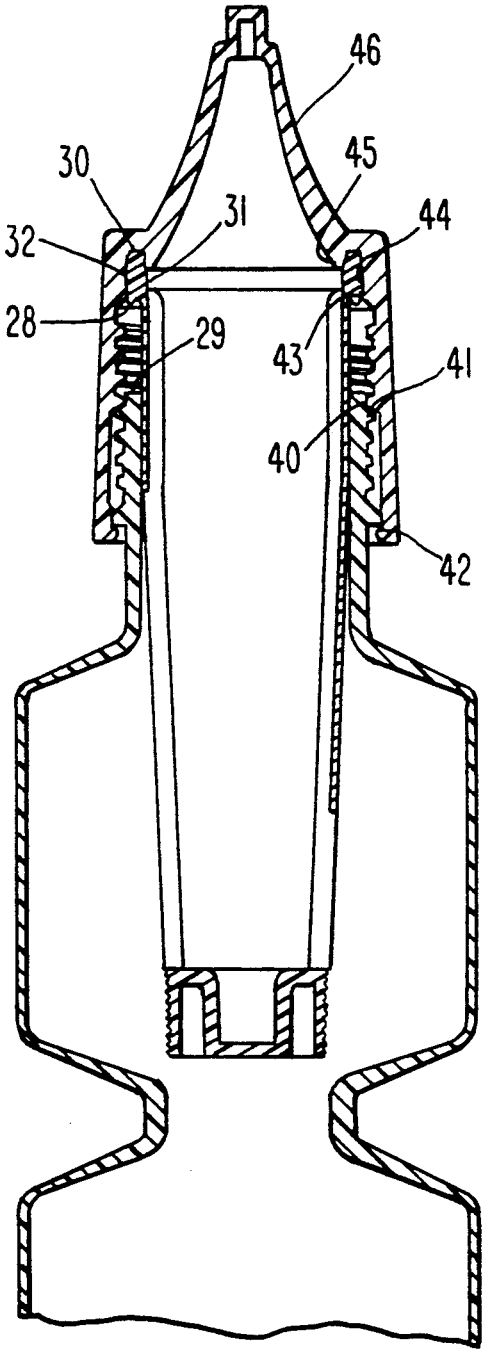
FIG. 2 is a cross-sectional view of the preferred embodiment shown in FIG. 1 in the open position.

Referring to FIGS. 1 and 2, there is shown a multi-chambered container 1 including a bottle with a waist 12 separating an upper chamber 5 from a lower chamber 6. A passageway 7 connects lower chamber 6 to upper chamber 5 and is preferably aligned with elongated neck 15 and exterior opening 23 of upper chamber 5 to receive a tubular member 2.

Preferably, the inside bottom surface **13*b* of upper chamber 5 slopes from the chamber sidewall downward to passageway 7, so that an ingredient in upper chamber 5 drains through passageway 7 when it is open. The inside top surface 13*a* of upper chamber 5 and the inside top surface 13*c* of lower chamber 6 slope upward to exterior opening 23 and passageway 7, respectively, to allow the contents of the chambers to drain when container 1** is inverted.

Tubular member 2 includes a stopper end 14, adapted to conform exactly to passageway 7 to effect a seal therein, and an open end 24. Open end 24 of tubular member 2 is preferably shaped as shown so that it can be assembled to the interior 44 of a cap 3 with an interference snap-fit to provide a seal between an inner skirt 45 of cap 3 and the inside diameter 31 of open end 24 of tubular member 2, and to provide a mechanical interlock between a retaining ring 43 of cap 3 and the outside diameter 32 of open end 24 of tubular member 2. The mechanical interlock is such that the force required to separate cap 3 and open end 24 is greater than the force required to unseat stopper end 14 from passageway 7. Alternatively, the top surface 30 of open end 24 may be heat-bonded, press-fitted, cemented, or in some other way attached to cap 3 to provide sealing characteristics and stopper end 14 pull-force resistance. Cap 3 also includes a means to allow dispensing from container 1 without removal of cap 3; preferably, an extended nozzle section 46 with a snip-off tip end 8.

Neck 15 has external threads 16 by which cap 3 and attached tubular member 2 are adapted to move axially along neck 15, between the "Closed Position" of FIG. 1 and the "Open Position" of FIG. 2, by unscrewing; the preferred embodiment being an unscrewing type. The cross-sectional form of threads 16 is configured so that threads 16 not only hold cap 3 onto neck 15 in a tightly sealed closed position, but also, without binding or jamming, will force cap 3 and interlocked tubular member 2 upward to unseat stopper end 14 and downward to restore stopper end 14 and seal passageway 7.

Neck 15 also includes a stop bead 19 which allows upward movement of cap 3 and attached tubular member 2, but deters removal of cap 3 from container 1 as it meets a similar bead 20 on the interior of cap 3. The cross-sectional form of stop bead 19 is configured so that it has an angular stop surface 21 which allows bead 20 to stretch easily over, top bead 19 as cap 3 moves downward during assembly to neck 15. Stop bead 19 has a straight lower surface 22 with a relatively sharp outer corner which will not allow bead 20 to stretch easily over stop bead 19 during upward movement of cap 3 and thereby, will deter removal of the cap 3 from the neck 15.

In the open position of FIG. 2, the closure thread start 40 rests on the upper surface of the neck thread start 41 and there is a small vertical distance 42 between bead 20 and stop bead 19. Stop bead 19 forms an interference seal with the closure sealing diameter 38 to block leakage of liquid which comes from between exterior opening 23 and the outer surface of tubular member 2 in the open position of FIG. 2. Alternatively, cap 3 may include a sliding interference seal between a seal ring on the interior diameter of the container exterior opening 23 and the exterior surface of the tubular member side wall 25 to prevent leaking in the open position of FIG. 2. In the closed position of FIG. 1, the lower surface of a concentric ring 28 molded to open end 24 of tubular member 2 forms a seal with the top surface 29 of neck 15 to prevent leakage of the ingredient in upper chamber 5 past cap 3.

Figure 3:
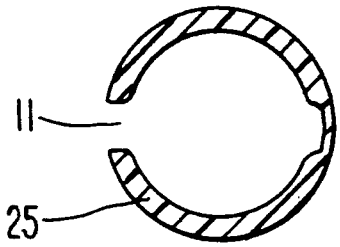
FIG. 3 is a sectional taken through the body of the tubular member along line A—A of FIG. 1.

As shown in FIGS. 1, 2 and 3, tubular member 2 is a hollow tube having two or more openings, for example, in the form of slots 11 through its side wall 25. There is a slight clearance between tubular member side wall 25 and the interior surface of neck 15. Slots 11 extend vertically along tubular member side wall 25 so that they extend into neck 15 when tubular member 2 is in the closed position of FIG. 1. When tubular member 2 is in the closed position as shown in FIG. 1, slots 11 allow upper chamber 5 to be filled with an ingredient through tubular member 2 while allowing air from upper chamber 5 to escape. When tubular member 2 is in the open position as shown in FIG. 2, slots 11 allow the commingled ingredients to be dispensed without becoming entrapped in the space between tubular member 2 and neck 15.

As shown in FIGS. 1 and 2, stopper end 14 of tubular member 2 is larger in diameter than passageway 7 to form an interference fit. The resiliency and flexibility of the material of stopper end 14 allows it to compress in diameter and exactly conform to the shape of passageway 7. Stopper end 14 also includes a series of seal rings 26 that compress and conform more easily than a straight surface, and reduce the amount of surface in contact with the side wall of passageway 7; smaller surface contact area reduces the amount of upward force necessary to unseat stopper end 14 from its sealed position in passageway 7. Wall thickness 27 of stopper end 14 is relatively thin to further aid its compressibility.

Figure 4:
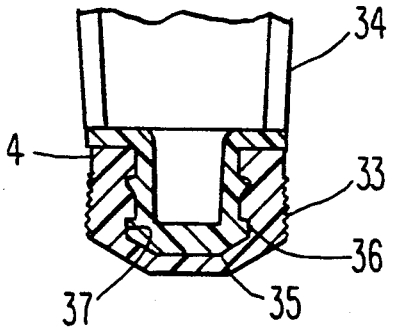
FIG. 4 is a cross-sectional view of an alternative embodiment of the stopper end of the tubular member of the preferred embodiment shown in FIG. 1.

FIG. 4 shows an alternative tubular member embodiment for use where requirements for sealing the passageway are severe due to the nature of the commingled ingredients (such as volatility, corrosiveness, or viscosity). The material used to mold the stopper 4 may be rubber or a thermoplastic elastomeric plastic so that the seal rings 33 will be softer and more resilient than seal rings 26 molded integrally on stopper end 14 of tubular member 2. Instead of stopper end 14, the alternative embodiment tubular member 34 incorporates a retaining end 35. Retaining end 35 has one or more undercut rings 36 on its exterior surface to match the undercut grooves 37 internal to stopper 4. Although stopper 4 is shown assembled to tubular member 34, it is also possible to mold stopper 4 directly to tubular member 34 in a sequential, two-step molding operation.

The multi-chambered container of the present invention is constructed so that in the closed position of FIG. 1, the consumer may sample the ingredient of the upper chamber before intermixing the ingredients of the two chambers. This is necessary in the case of hair-dye liquid, for example, where the consumer must perform a "patch test" for indication of an allergic reaction, before use of the product mixture. Before mixing and using the contents, the consumer cuts off tip end 8 of the nozzle orifice 9 and withdraws a few drops of the ingredient from upper chamber 5 for testing.

Figure 5:
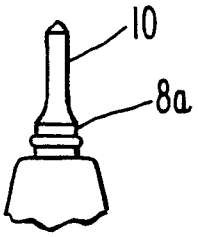
FIG. 5 is a detail view of an alternative closure dispensing nozzle.
Figure 6:
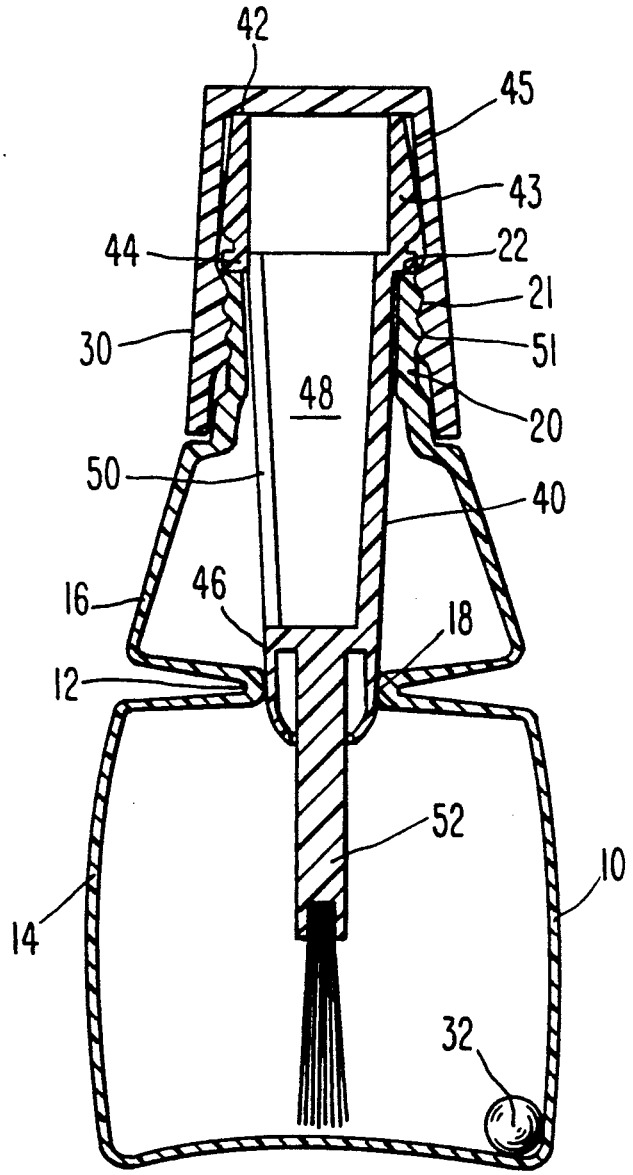
PRIOR ART Fig. 6
FIG. 6 is a cross-sectional view of a prior dual-chambered container developed by the assignee of the present invention.

FIG. 5 shows an alternative design for the tip end 8*a*, which allows the consumer to plug nozzle orifice 9 with a projection 10 on tip end 8*a* after it has been cut off and inverted. Plugging orifice 9 protects the package from spillage during the test period and prevents oxygen from entering upper chamber 5 and reacting with an oxygen-sensitive ingredient.

The consumer makes use of the commingled ingredients by unscrewing cap 3 as far as it will go, since cap 3 is not removable from neck 15. As cap 3 is unscrewed, attached tubular member 2 also moves upward and unseats stopper end 14 from its sealed position in passageway 7, and thereby allows the ingredient of upper chamber 5 to drain into lower chamber 6 through passageway 7. The consumer may thoroughly intermix the two ingredients by shaking or inverting container 1. Spillage is prevented by holding one finger over orifice 9. Spillage may also be prevented after intermixing of the ingredients by screwing cap 3 and attached tubular member 2 downward into the closed position, thereby sealing the combined ingredients of the upper and lower chambers in lower chamber 6.

The commingled ingredients may be dispensed from the open position by inverting container 1, positioning the end of orifice 9 to where the product is to be applied and squeezing the sidewalls of lower chamber 6. As the consumer inverts the package, the product in lower chamber 6 flows through passageway 7 into upper chamber 5, then through slots 11 in side wall 25 of tubular member 2 into the interior volume of cap 3 and finally through orifice 9.

In making use of the multi-chambered container of the present invention on a fitting/packaging line, container 1 is constructed so that lower chamber 6 is first filled with a product ingredient. After tubular member 2 is inserted into container 1, thereby sealing off lower chamber 5 at passageway 7, a second product ingredient may be added to upper chamber 5 through open end 24 of tubular member 2, into tubular member 2, and through slots 11 in tubular member sidewall 25. Once upper chamber 5 is filled, cap 3 is screwed onto neck 15 to seal container 1 and to engage open end 24 of tubular member 2 with a snap fit.

Although specific embodiments of the invention have been described in detail herein, other variants of the invention may be made by those skilled in the art, which nevertheless embody the essence of the present invention. All such variations are understood to be encompassed within the scope of the following claims.

I claim:

1. A container for holding separated ingredients to be commingled, and for commingling and dispensing said ingredients, comprising:

(a) at least two chambers having a cross-sectional area circumscribed by a side wall of said container, each chamber adapted to hold one of said ingredients to be commingled, the first of said chambers having an exterior opening;

(b) a passageway connecting said chambers with an axis centrally disposed in said passageway and extending through said first chamber of said exterior opening, said passageway having a side wall circumscribing a cross-sectional area, perpendicular to said axis, smaller than the cross-sectional area, perpendicular to said axis, circumscribed by said side wall of said first chamber;

(c) a tubular member located substantially within said first chamber, the first end of which is open to said exterior opening and the second end of which includes a stopper which, in a closed position, seals said passageway by contact of a sealing surface at said second end with said side wall of said passageway, said member further including a second opening from the interior of said tubular member to said first chamber, said opening comprising at least one elongated slot in said tubular member extending substantially from said first end to said second end, said slot being adapted to function both as an air vent and as a fluid flow path;

(d) a cap attached to said first end of said tubular member, said cap adapted to move with said tubular member between a closed position in which the second end of said tubular member is sealed in and blocks said passageway, and an open position, wherein said second end of said tubular member is not in said passageway, the top of said cap having a means for dispensing ingredients from said first end of said tubular member, through said cap, to the exterior of said container.

2. A container as set forth in claim 1 wherein said tubular member and said cap are adapted to be attached together after said tubular member has first been placed in said container with said second end of said tubular member sealing said passageway.

3. A container as set forth in claim 2 wherein said cap in said open position is adapted to prevent leakage through a seal formed between a bead on said container exterior surface in contact with the inside surface of said cap.

4. A container as set forth in claim 2 wherein said cap in said open position is adapted to prevent leakage through a seal formed by the inside surface of said container exterior opening in contact with the outside surface of said tubular member.

5. A container as set forth in claim 2 wherein said sealing surface of said second end of said tubular member is integral to said second end of said tubular member.

6. A container as set forth in claim 2 wherein said sealing surface of said second end of said tubular member comprises resilient rubber or thermoplastic elastomeric material fastened to said second end of said tubular member.

7. A container as set forth in claim 2 wherein said side wall of said container is thin enough to dispense said ingredients by squeezing said container.

8. A container as set forth in claim 2 wherein said cap is elongated to form a nozzle with a removable tip, said nozzle openable by removal of said tip.

9. A container as set forth in claim 8 wherein said removable tip of said closure nozzle is a snip-off plug.

10. A container as set forth in claim 9 wherein said snip-off plug is adapted to be easily inserted and removed from the opening of said dispensing nozzle after initial removal.

11. The container of claim 1 wherein said stopper is integral to said second end of said tubular member.

12. The container of claim 1 wherein said stopper has a thin side wall and axial indentations undercut in said stopper, said side wall deformable with said side wall of said passageway such that said side wall of said stopper is biased outward to seal said passageway.

13. The container of claim 11, wherein said tubular member and stopper are a one piece molded member.

* * * * *

UNITED STATES PATENT AND TRADEMARK OFFICE

CERTIFICATE OF CORRECTION

PATENT NO. : 5,088,627

DATED : February 18, 1992

INVENTOR(S) : Robert J. Musel

It is certified that error appears in the above—identified patent and that said Letters Patent is hereby corrected as shown below:

Column 4, line 33, after "over", delete ",".

Column 6, line 11, delete "fitting/packaging" and insert --filling/packaging--.

Signed and Sealed this

Twenty-first Day of September, 1993

Bruce Lehman

*Attest:*

BRUCE LEHMAN

*Attesting Officer*

*Commissioner of Patents and Trademarks*